United States Patent [19]

Kuo

[11] 4,444,178

[45] Apr. 24, 1984

[54] INCLINED TRACTION FRAME

[76] Inventor: Ming C. Kuo, 19350 Christina Ct., Cerritos, Calif. 90701

[21] Appl. No.: 419,226

[22] Filed: Sep. 17, 1982

[51] Int. Cl.[3] ..... A63B 23/02

[52] U.S. Cl. ..... 128/74; 272/145

[58] Field of Search ..... 272/144–145, 272/134; 128/74–75, 71, 69, 24 R, 33

[56] References Cited

U.S. PATENT DOCUMENTS

| | | | |
|---|---|---|---|
| 2,934,063 | 4/1960 | Elsasser | 128/33 |
| 3,286,708 | 11/1966 | Gartner | 128/24 R |
| 4,114,613 | 9/1978 | Kuhn | 128/71 X |
| 4,136,868 | 1/1979 | Hogue | 272/145 |
| 4,232,662 | 11/1980 | Barber | 272/144 X |

*Primary Examiner*—Richard J. Apley
*Assistant Examiner*—Chris Coppens
*Attorney, Agent, or Firm*—Christie, Parker & Hale

[57] ABSTRACT

A traction frame supports the body of a user in an angularly inclined, inverted position. The traction frame includes a body-supporting frame mounted in a stationary angular position. A leg support beam, extends axially away from the body-supporting frame to an elevated position above the upper end of the frame. A pair of ankle support pads on the beam support the underside of the user's lower legs. A lever arm extends above and parallel to the beam and pivots to the upper end of the beam. A pair of instep support pads on the lever arm can pivot to a locked position in which the user's lower legs are fastened between the instep support pads and the ankle support pads. The lever arm pivots toward the locked position along a guide having a latch engaged by a spring-biased detent in the lever arm. The detent latches in a snap lock to positively prevent the instep pads on the lever arm from rotating away from the ankle support pads. The lever arm can be released from its locked position by pulling axially on the lever arm against the bias of the detent to release the detent from the latch, allowing the lever arm to pivot away.

14 Claims, 12 Drawing Figures

INCLINED TRACTION FRAME

CROSS REFERENCE

This application is based on my Disclosure Document No. 107,203, filed Mar. 29, 1982.

FIELD OF THE INVENTION

This invention relates to devices for therapeutic treatment of back and neck problems; and more particularly, to an inclined traction frame for supporting the body of a user in an inverted position.

BACKGROUND OF THE INVENTION

Recently, a number of traction devices have been developed for use in the home by persons suffering from back or neck problems. The purpose of these traction devices is to hold the user in an inverted position so the neck and back are placed in traction, free of compression. This can alleviate the pain of back or neck problems, as well as relieving muscle tension and stress.

One recently developed traction device comprises a frame freely suspended from a crossbar. The user fastens his lower legs to the frame and hangs from the frame in an inverted position. Another recently developed traction device comprises a pair of inversion boots with hooks for allowing the user to hang upside down on a crossbar. With these devices, it is difficult and usually very awkward for the user to somehow get into the inverted position, particularly if the user is suffering the pain of back or neck problems. Users commonly require assistance to use these traction devices. These devices also apply a full traction force to the user; and in many instances, it would be more desirable to apply less traction force, or at least a controlled amount of traction force.

Another type of traction device comprises a frame having two frame sections that swing relative to one another about a transverse axis. The user is held in an inclined position on the frame by a releasable leg-clamping mechanism. The user can perform exercises assisted by the swinging movement of the frame sections. By shifting his or her weight, the user can change the angle of the frame. However, only a slight shift of weight can upset the stability of the frame and cause it to swing suddenly, which may not be desirable for many users suffering the pain of back or neck problems. In addition, many prior art leg-clamping mechanisms are not comfortable for use over extended periods of time; and many of them are not effective in locking onto the user's lower legs so that the user's legs are absolutely locked. Furthermore, the swinging movement is not safe. If the user stretches his hands laterally by accident during swinging action, his hands could be caught by the frame stand.

SUMMARY OF THE INVENTION

This invention provides an inclined traction frame in which the body-supporting frame is held in any of a number of stationary angularly inclined positions. The device includes a leg-clamping mechanism which can be operated quickly and easily without assistance. The combined stability of the traction frame and ease with which the leg-clamping device can be operated make it possible for users with back or neck problems to conveniently and safely attach themselves to the leg-clamping device, without requiring awkward movements, or causing uncomfortable or unsafe strain or tension on the neck or back.

Briefly, the traction frame includes an inclined body support frame held at a fixed stationary angle, an elongated leg support beam extending to an elevated position beyond an upper end of the frame, and a legclamping mechanism carried on the leg support beam. The clamping mechanism includes an ankle rest for supporting the underside of the user's lower legs in the vicinity of the ankles. An instep support is carried on a lever arm that pivots about an elevated end portion of the leg support beam. The instep support is raised away from or lowered toward the ankle support when the lever arm pivots away from or toward the leg support beam. The lever arm is engaged with a guide for guiding pivotal motion of the lever arm toward or away from the leg support beam. A latch on the guide is engaged by a spring-biased detent on the lever arm in a snap lock when the lever arm is lowered toward the leg support beam. This holds the instep support means in a fixed position adjacent the ankle support, with the lever arm being held in a positively locked position preventing the lever arm from pivoting away from the leg support beam. The lever arm can be moved axially relative to the leg support beam against the bias of the spring-biased detent for releasing the detent from its locked position on the latch. This allows the lever arm to rotate away from the locked position to widen the spacing between the instep support and the ankle support.

The user can be easily secured to the traction frame. The user simply sits on the upper end of the frame, which is held in a stable, stationary position. The user then grips the lever arm to stabilize himself while placing his ankles on the ankle supports. The lever arm is then simply pivoted downwardly to lock it in place, with the instep supports held in a positively locked position. The user then can safely be supported on the frame in an inverted position. The leg-clamping device can be released by simply pulling on the lever arm to unlock it. As a consequence of the ease with which the leg-clamping device can be locked and unlocked, the inclined traction frame can be used safely and without causing the discomfort associated with other traction devices.

Since the traction frame can be set at different stationary angles, the amount of traction force also can be easily controlled.

In addition to these advantages, the inclined traction frame can be made from very light weight materials, is easy to handle, can be folded to a compact size for storage, and can be inexpensively manufactured. The traction frame also is completely adjustable for users of different height or size.

These and other aspects of the invention will be more fully understood by referring to the following detailed description and the accompanying drawings.

DRAWINGS

DETAILED DESCRIPTION

Figure 1:
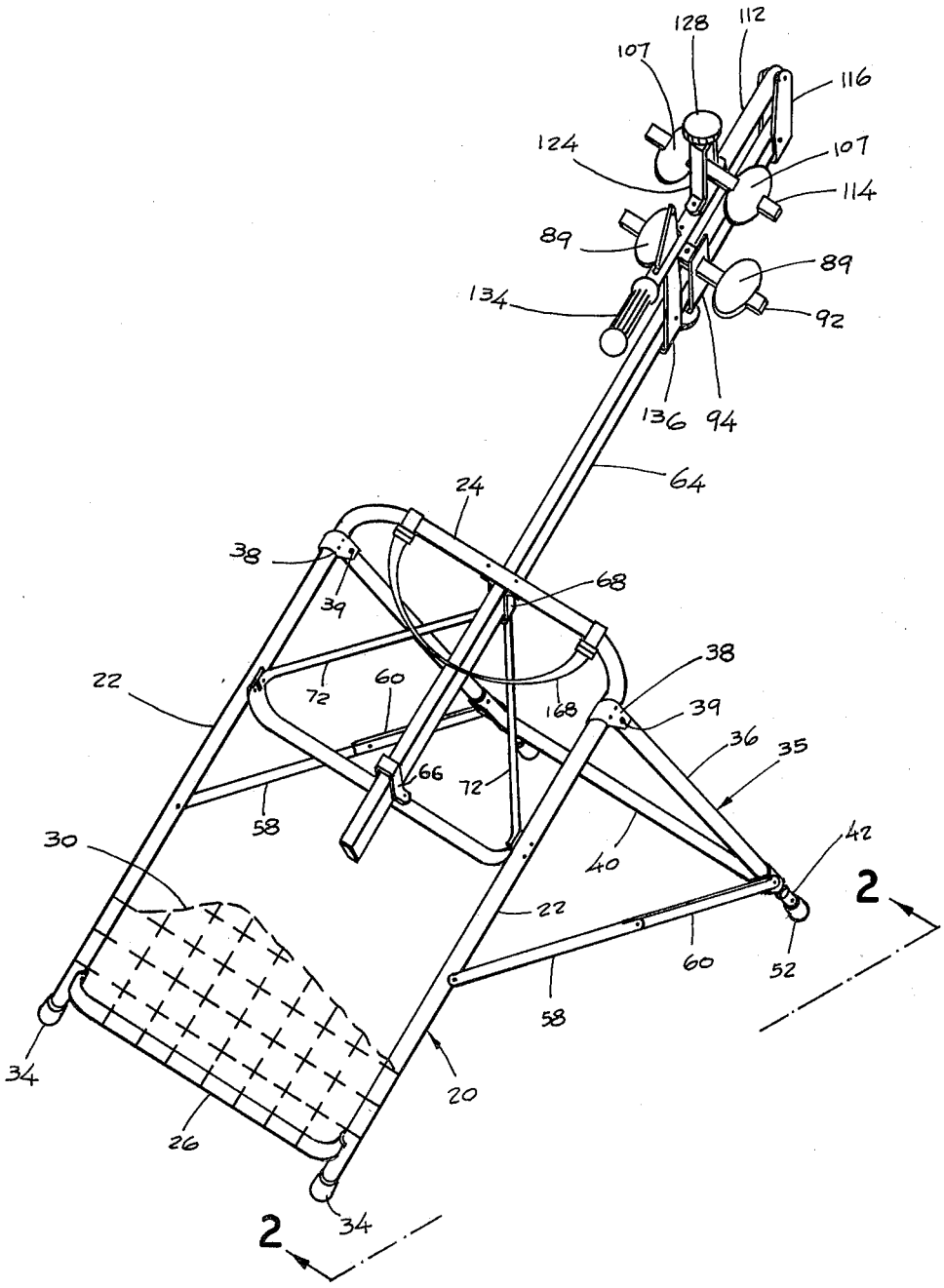
FIG. 1 is a perspective view illustrating an inclined traction frame according to principles of this invention.

Referring to FIG. 1, an inclined traction frame includes a rectangular body-supporting frame 20 having an inverted U-shaped frame with parallel legs 22 extending along opposite sides of the frame and a rigid cross-bar 24 at the upper end of the U-shaped frame. A rigid lower crossbar 26 has its opposite ends bent at right angles and rigidly secured to opposite lower portions of the legs 22 of the U-shaped frame.

Body-supporting straps 30 at right angles to one another are fastened to the legs 22 and to the cross-bars 24 and 26 of the U-shaped frame. The body-supporting straps provide a flat, comfortable body-supporting surface for supporting the weight of the user in the rectangular region within the frame 20.

A rigid upwardly opening U-shaped crossbar 32 is rigidly affixed to the legs 22 for providing intermediate bracing for the U-shaped frame.

Rubber end caps 34 provide a foot rest for supporting the lower ends of the legs 22 on the floor.

The U-shaped frame, the crossbar 26, and the brace 32 are all made of aluminum tubing. The body-supporting straps are made of nylon or vinyl lacing.

A support frame 35 includes a pair of tubular frame support legs 36 extending downwardly at an angle from the upper end portions of the legs 22. The upper ends of the frame support legs are hinged to brackets 38 secured to the frame legs 22. Pivot pins 39 hinge the legs to the brackets. A crossbrace 40 is rigidly secured to the frame support legs 36 to form a rigid support frame that pivots about a transverse axis through the pivot pins 39. The frame support legs 36 and the crossbrace 40 are made of aluminum tubing.

Figure 2:
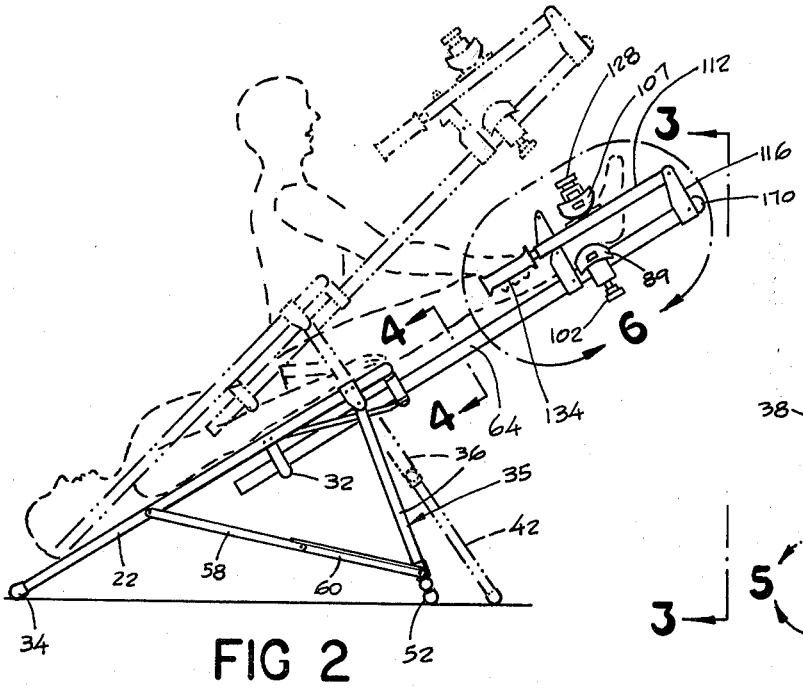
FIG. 2 is a side elevation view of the traction frame taken on line 2—2 of FIG. 1.
Figure 3:
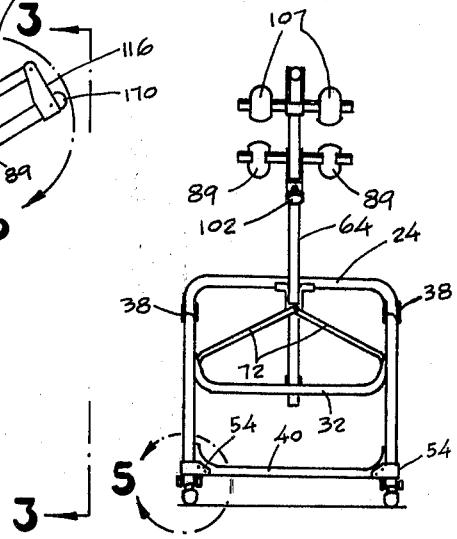
FIG. 3 is an end elevation view of the traction frame taken on line 3—3 of FIG. 2.

Separate extension legs 42 are slidably disposed inside the frame support legs 36. As shown best in FIGS. 5 and 8, the cross section of each extension leg has a pair of opposite grooves 44 extending along the length of each leg. A series of longitudinally spaced apart through-holes 46 are located in the grooves along the length of each extension leg. Separate threaded pins 48 extend through lower portions of the frame support legs and through a corresponding pair of the through-holes 46. A separate nut 50 can be finger tightened onto the end of each pin 48 for securing the extension legs in a rigid position relative to the frame support legs. The extension legs 42 can be shortened or lengthened, as shown in phantom lines in FIG. 2, for adjusting the angle of inclination of the body-supporting frame.

Rubber end caps 52 provide a foot rest for supporting the lower ends of the extension legs 42 on the floor.

Figure 5:
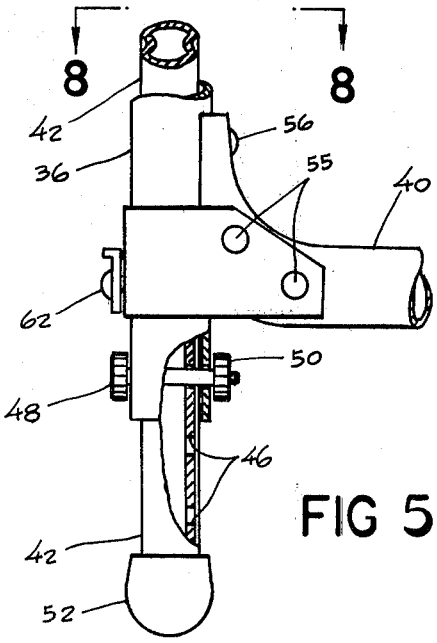
FIG. 5 is a fragmentary elevation view showing the frame structure within the circle 5 of FIG. 3.
Figure 8:
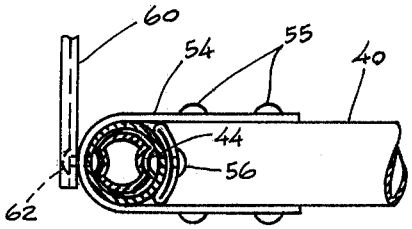
FIG. 8 is a fragmentary top plan view, partly in cross section, taken on line 8—8 of FIG. 5.

As shown best in FIGS. 5 and 8, the crossbrace 40 has its opposite ends bent at right angles and rigidly secured to brackets 54 affixed to lower end portions of the frame support legs 36. Rivets 55 rigidly affix the end portions of the crossbrace 40 to the brackets 54. Rivets 56 also fasten opposite end portions of the crossbrace 40 to the frame support members 36. The rivets 56 ride in the inside grooves 44 of the extension legs for guiding axial travel of the legs and for preventing rotation of the extension legs relative to the frame support legs. Besides serving as a foot step for supporting the weight of the user mounting the traction frame, the crossbrace also strengthens lateral stability of the leg support frame.

A pair of tension arms 58 and 60 limit the angle through which the support frame 35 pivots away from the body-supporting frame. The tension arms are hinged at their inner ends to fold back on each other when the frame is collapsed. They extend to a collinear position when the support frame 35 is spread apart from the body-supporting frame 20 during use. On each side of the body-supporting frame, one of the tension arms can have an upper portion extended beyond the hinge to rest against the upper edge of the other arm for preventing the pair of arms from collapsing downwardly. Each tension arm 60 is fastened to a corresponding frame support leg 36 by a separate rivet 62 (see FIGS. 5 and 8). Each rivet 62 rides in a corresponding outer facing groove 44 in a corresponding extension leg for cooperating with the rivet 56 to guide lengthwise travel of the extension legs and to prevent their rotation. This assists in alignment of the holes 46 in the extension legs with corresponding holes in the frame support legs 36 for placing the pins 48 to set the angle of the body-supporting frame. Meanwhile, the grooves 44 provide space for the heads of rivets 56, 62.

Figure 4:
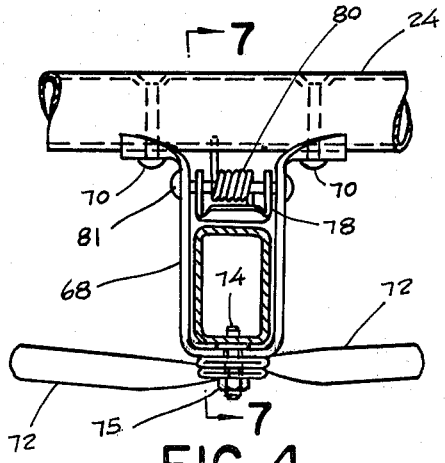
FIG. 4 is a fragmentary elevation view, partly in cross section, taken on line 4—4 of FIG. 2.
Figure 7:
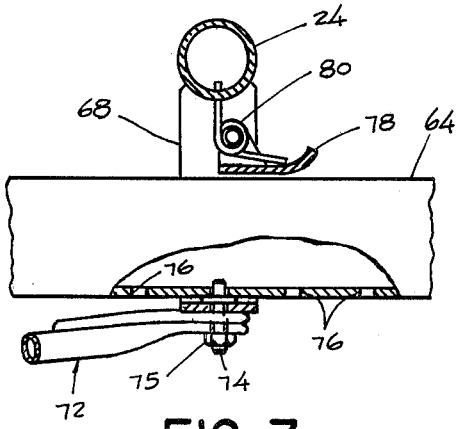
FIG. 7 is a fragmentary side elevation view taken on line 7—7 of FIG. 4.

Referring again to FIG. 1, an elongated leg support beam 64 extends axially away from the upper crossbar 24 at the top of the body-supporting frame 20. The lower portion of the leg support beam 64 is slidable axially in a pair of axially spaced apart rectangular guide tubes affixed to the underside of the frame. The lowermost guide tube is formed by an inverted U-shaped bracket 66 rigidly secured to the center of the transverse crossbrace 32. As shown best in FIGS. 4 and 7, the uppermost guide tube is formed by a U-shaped channel 68 rigidly affixed to the underside of the crossbar 24 by fasteners 70. The leg support beam is slidable in the lower portion of the channel 68. The bottom of the channel is supported by a pair of diagonal cross members 72 having their lower outer ends rigidly secured to the legs 22 of the body-supporting frame. The two diagonal cross members converge toward one another in a direction toward the top of the frame, and the ends of the cross members are mutually fastened to the bottom of the U-shaped bracket by a flanged double end stud 74 and a nut 75, shown in FIGS. 4 and 7. The upper shank of the stud 74 projects upwardly into the interior of the channel 68 for engaging one of a series of longitudinally spaced apart holes 76 in the bottom of the leg support beam 64. A curved locking clip 78 is affixed to the channel 68 above the beam 64. The clip 78 is spring biased by a torsion spring 80 carried on a pin 81, so that the face of the clip can press downwardly against the upper face of the beam 64. The clip's base is located further away from its hinge than its back edge. The spring 80 always forces the clip's base close in against the upper face of the beam 64. This action allows the clip's base to block the beam from raising upward because it provides a positive lock. When the clip is rotated upward, its base is moved away and its back edge positioned above the beam to provide clearance for the beam to raise upward. With the locking action of the pin and the downward force applied by the clip, the beam can be secured in a fixed position relative to the frame 20 at any of a number of desired locations along the length of the beam. In use, the clip 78 can simply be rotated against the spring force to provide clearance at the top of the beam 64 to allow the beam to be raised off of the shank portion of the fastemer 74 and then allow the beam to be moved longitudinally to any of a desired number of positions for lengthening or shortening the beam with respect to the body support frame. Any one of the holes 76 in the beam then can be re-engaged with the shank of the fastener 74, after which the clip is rotated down to the position shown in FIG. 7 for holding the beam in a fixed position on the frame.

The upper end portion of the beam is spaced from and elevated relative to the upper crossbar 22 of the body-supporting frame. A leg clamping assembly 82, shown best in FIGS. 6 and 9 through 12, is carried on this elevated upper end portion of the beam. The leg clamping assembly includes ankle support means 84 for supporting the underside of the user's lower legs in the vicinity of the ankles and instep support means 86 for supporting the instep region of the user's legs.

The ankle support means 84 include a pair of laterally spaced apart ankle support pads 89 in the form of separate upwardly opening, generally saddle-shaped metal backing plates 88 with padding 90 on their upper surfaces. The padding can be sponge rubber or polyurethane foam, for example. The ankle support pads 89 are carried on a transverse lower support bar 92 affixed to the leg support beam 64 so that the ankle support pads are on opposite sides of the beam. The lower support bar is rectangular in cross section and extends through cooperating rectangular holes in each ankle support pad. A U-shaped bracket 94 extends around the bottom and opposite outer edges of the leg support beam 64. The flanges of the bracket protrude above the top of the beam, and the lower support bar is secured to the protruding upper portions of the flanges. The central portion of the transverse support bar rests on the upper face of the beam. A series of axially spaced apart holes 96 are drilled in the upper face of the beam. The holes provide means for adjusting the position of the ankle support pads along the length of the beam. An ankle support placement pin 98 extends through a small rectangular plate 100 and is threaded into the center of the transverse bar 92. A protruding lower end portion of the pin 98 extends through any one of the several holes 96 in the beam 64 for holding the ankle support pads in a desired fixed position on the beam. The rectangular plate 100 is confined by the opposite flanges of the bracket 94 which limits lateral movement of the transverse support bar 92 relative to the U-shaped bracket 94.

The U-shaped bracket 94 is loosened or tightened to the leg support beam by a knob screw 102 which extends through a hole in the lower face of the beam. The shank of the knob screw is threaded through a press nut 104 clinched on the inside of the bracket for holding the knob screw in place. A compressible end cap 106 on the end of the shank bears against the underside of the beam. The knob screw is tightened to apply pressure through the end cap 106 to the bottom of the beam for securely holding the bracket 94 in a fixed position on the beam. This holds the ankle support pads in the desired fixed position on the beam. The knob screw can be loosened to draw the end cap away from the bottom face of the beam for providing sufficient clearance for allowing the protruding bottom portion of the pin 98 to be released from any one of the holes 96 in the top face of the beam. This allows the ankle support pads, along with the transverse bar 92 and the bracket 94, to slide lengthwise along the beam to any other desired position, after which the pin 98 can be relocated in another one of the holes 96 and the knob screw 102 tightened against the bottom face of the beam.

The instep support means 86 comprises a pair of laterally spaced apart instep support pads 107 comprising separate downwardly opening, generally saddle-shaped metal backing plates 108 with padding 110 on their lower surfaces. The padding can be foam rubber or polyurethane foam. The instep support pads are affixed to opposite sides of an elongated tubular swing arm 112 (also referred to as a lever arm) spaced above and extending parallel to the leg support beam 64. The instep support pads are carried on an elongated transverse upper support bar 114 which, in turn, is mounted to the swing arm 112. This mounts the instep pads on opposite sides of the swing arm. The outer end of the swing arm is hinged to the outer end of the leg support beam so that the swing arm can pivot about a transverse axis relative to the beam. The hinge includes a U-shaped bracket 116 rigidly affixed to the end of the beam by fasteners 118 and 120. The flanges of the bracket 116 project above the beam 64, and a transverse pivot pin 122 hinges the end of the swing arm to the upper portions of the flanges so that the swing arm can pivot relative to the bracket 116. This allows the swing arm to pivot through an angle toward or away from the upper face of the leg support beam 64.

A downwardly facing U-shaped bracket 124 is rigidly affixed to the upper surface of the swing arm. The bracket 124 has outer flanges bent at right angles and resting on axially spaced apart portions of the swing arm. Fasteners 126 extend through the flanges of the bracket 124 for rigidly affixing the bracket to the swing arm. The upper support bar 114 extends through the U formed by the bracket 124 and is held in a fixed position inside the bracket by a knob screw 128. A threaded shank portion 130 of the knob screw is threaded through a cooperating threaded opening in the bar 114 and a smaller upper stub end of the shank extends through the upper portion of the bracket 124. The knob is mounted on the upper stub end. A smaller lower stub end of the shank engages in a hole on the upper face of the swing arm as shown best in FIG. 9. Therefore, the knob screw is confined. Rotation of the knob screw about its axis provides means for raising or lowering the upper support bar 114 relative to the swing arm. This, in turn, raises or lowers the elevation of the instep pads relative to the swing arm, to provide means for adjusting the spacing between the instep pads relative to the ankle support pads.

During the traction, the halves of pads 89, 107 pointing away from the user's body engage with ankle and instep respectively. Both halves of each pad are made to fit two different general sizes of feet. For example, one half fits bare feet, the other fits the foot with a shoe on. The pads 89, 107 are allowed to slide off their support bars individually and be placed back on. They are held in place by friction only.

A telescoping locking bar 132 is slidably disposed in an end portion of the tubular swing arm closest to the body-suporting frame. A handle 134 for use in gripping the locking bar is secured to the end of the locking bar closest to the body-supporting frame.

A narrow swing arm guide 136 is rigidly affixed to the leg support beam 64. A lower tubular portion 138 of the guide is rigidly affixed to the beam by fasteners 140. The upper portion of the guide projects through vertically aligned narrow slotted openings 142 and 144 in the swing arm 112 and the locking bar 132, respectively. The face of the guide closest to the free end of the locking bar has a downwardly wider tapering cam surface 146, a recessed edge forming a latch 148, a vertically extending locking edge 150 at the inner end of the latch, and a tapering lower surface 152 tapering wider outwardly below and away from the bottom of the locking edge 150. A rivet 154 extends through the top portion of the guide to provide an upper stop for the swing arm. A rivet 156 extending through the guide below the swing arm provides a lower stop for the swing arm.

Figure 6:
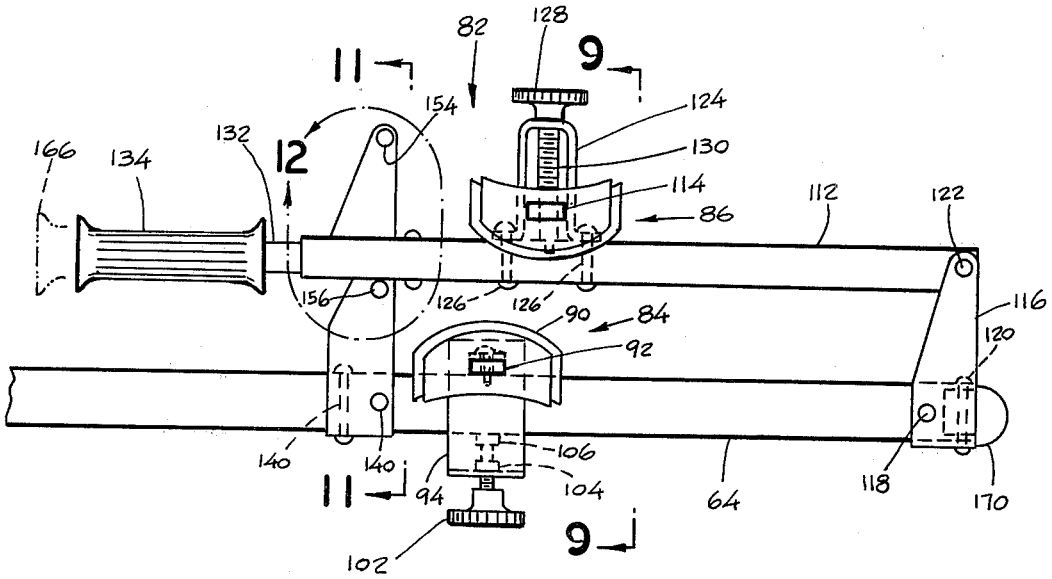
FIG. 6 is a fragmentary side elevation view of the leg-clamping means shown within the circle 6 of FIG. 2.
Figure 9:
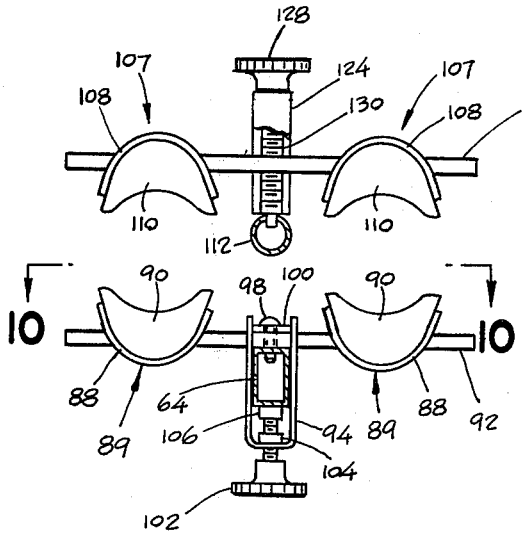
FIG. 9 is an end elevation view, partly in cross section, taken on line 9—9 of FIG. 6.
Figure 12:
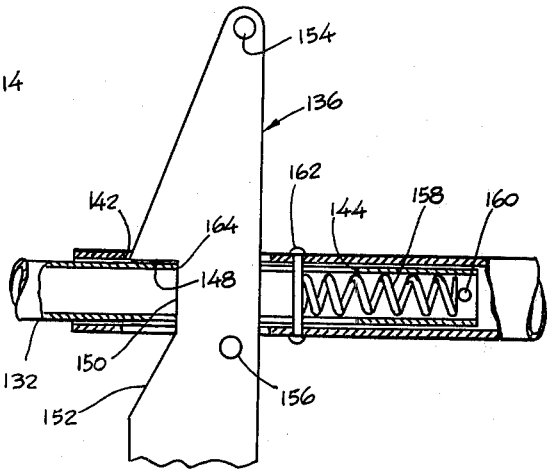
FIG. 12 is a fragmentary side elevation view, partly in cross section and partly broken away, showing the locking mechanism within the circle 12 of FIG. 6.
Figure 10:
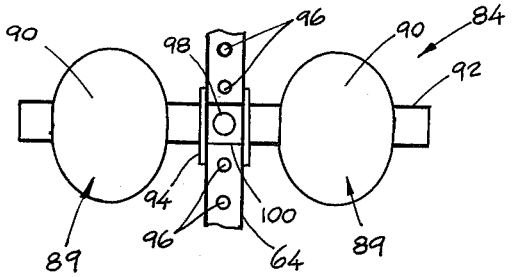
FIG. 10 is a fragmentary top plan view taken on line 10—10 of FIG. 9.
Figure 11:
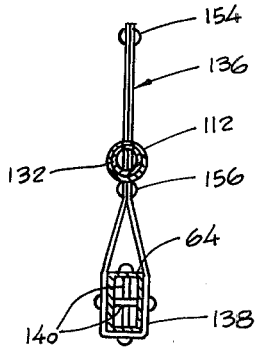
FIG. 11 is a cross-sectional view taken on line 11—11 of FIG. 6.

The locking arm is movable outwardly from the end of the swing arm against the bias of a compression spring 158 inside the locking arm. The compression spring is confined within the locking arm between a rear stop pin 160 secured to the end of the locking arm inside the swing arm and a front stop pin 162 secured to the swing arm adjacent the guide 136. The swing arm is shown in FIGS. 6 and 12 in the locked position, with a locking edge 164 (also referred to as a detent) of the slotted opening 144 in the locking bar being engaged against the locking surface 150 of the guide beneath the latch 148. The locking edge 164 is maintained in this locked position by the bias of the compression spring 158, which normally urges the locking bar to slide inwardly into the swing arm to the locked positions shown in FIGS. 6 and 12. To unlock the locking arm, the locking arm is pulled axially outwardly from the swing arm (to a position shown in phantom lines at 166 in FIG. 6). This causes the locking edge 164 of the slotted opening 144 to clear the front corner of the latch 148 and align the slotted openings 142 and 144 so that the swing arm then can be rotated upwardly away from the leg support beam 64. The guide 136 guides upward and downward angular travel of the swing arm relative to the leg support beam 64. During its upward and downward travel, the locking edge 164 of the locking bar rides on the cam surface 146 of the guide. The upper stop pin 154 prevents the swing arm from rotating off the guide. When the swing arm is lowered, the locking edge 164 rides downwardly on the cam surface 146 until it reaches the bottom of the cam surface, at which point the bias of the compression spring snap locks the locking edge 164 of the slotted opening into engagement with the locking edge 150 of the guide. This latches the locking bar in a positively locked position beneath the latch 148. In the locked position, the swing arm is prevented from rotating upwardly away from the leg support beam, which holds the instep support pads in a fixed position above the ankle support pads.

In using the inclined traction frame, the body-supporting frame 20 is first placed at the desired stationary angle relative to the floor. The angle of inclination is set by removing the pins 48 and moving the extension legs 42 in or out of the frame support legs 36 to the position that provides the desired angle. The extension legs are then secured to the desired position by tightening the nut 50 on each pin 48. The leg support beam 64 is then adjusted to the desired length. The clip 78 is rotated away from the top of the beam to provide clearance for the pin 74 so that the beam can be disengaged from the pin to slide the beam lengthwise to shorten or lengthen it with respect to the body-supporting frame. The preset length of the beam is set to match the length of the user's legs. The desired length of the beam is determined by the distance from the upper end of the frame to the instep support pads. That is, the beam is set at a length which allows the instep pads to be properly positioned on the instep portions of the user's lower legs when the foot-clamping mechanism is used. The knob screw 102 is then loosened to provide clearance for the pin 98, and the ankle support bar is moved lengthwise to the desired position of the ankle support pads, relative to the instep pads. The knob screw 102 is then tightened. The knob screw 128 can be operated to adjust the spacing of the instep pads 107 above the ankle support pads. The adjustment of the knob screws 102 and 128 allow the ankle and instep pads to conform to the size of the user's lower legs by the adjustments of the vertical spacing between the pads and the longitudinal spacing between the pads.

The user then sits on the upper crossbar 24 on the body-supporting frame and extends his legs upwardly and outwardly to rest the underside of his legs on the ankle suport pads. This is illustrated best in phantom lines in FIG. 2. With the locking bar 132 released from its locked position on the guide 136 (the unlocked position is shown best in phantom lines in FIG. 2), the user is able to place the underside of the ankles on the ankle support pads, under the instep support pads. While sitting on the upper bar 24 of the frame, the user may stabilize himself with the safety belt 168. The safety belt can be wrapped around the backside of the user for preventing him from sliding before his feet are secured by the foot-clamping device. The length of the safety belt can be adjusted. The user also can stabilize himself by holding onto the handle 134 of the locking bar. The handle 134 can be gripped with one hand and the other hand can be placed on the upper bar 24 of the stationary frame for added stability. Once the user's legs are in place on the ankle support pads, the swing arm 112 is into position under the latch 148 on the guide 136. This allows the instep pads to confine closely to the instep regions of the user's legs for holding the User's legs in a fixed position elevated above the body-supporting frame. The user is then safe to rest in the inverted position on the body support frame, as shown best in phantom lines in FIG. 2. When the user wishes to release the leg-clamping device, he simply sits up in the upright position and pulls back on the handle 134 of the locking bar to disengage the locking bar from the latch. The locking bar and swing arm are then rotated upwardly to increase the spacing between the instep pads and the ankle pads so that the user can remove his legs from the leg-clamping device.

The inclined traction frame of this invention is very light in weight and compact in size for easy handling and storage. It can be set up easily and adjusted to fit people of different heights or sizes. It is also comfortable to use and safe to operate. Because of its structural simplicity, it can be made from mostly aluminum tubular section. Since there are no welding or expensive machining operations involved for fabrication, and it can be produced and sold at low prices.

The frame has multiple positions to vary the intensity of gravity pull and its gravity pull is constant at each angular position. Therefore, it is easier to adjust to each individual's requirements. Due to its stable, stationary position during traction, movement of the arms or the body does not affect the stability of the frame. This makes it ideal for sit-up exercises, which may not be possible for many traction devices available today. A rubber bumper 170 (see FIG. 6) secured to the outer end of the beam by the rivet 120 can be used for stabilizing the end of the traction frame against a wall or other stationary support when the traction frame is used for sit-up exercises.

I claim:

1. An inclined traction frame comprising:

a body-supporting frame;

means for mounting the body-supporting frame in a fixed angularly inclined position, the body-supporting frame in its angular position having an elevated upper end sufficient to support the weight of a user;

an elongated rigid leg support beam extending axially away from the body-supporting frame to an elevated position spaced from and elevated above the upper end of the body-supporting frame;

ankle support means carried on the leg support beam for supporting the underside of the user's lower legs in the vicinity of the ankles;

an elongated lever arm extending along and above the leg support beam;

means pivoting the lever arm to the leg support beam on the side of the beam opposite the ankle support means;

instep support means carried on the lever arm for supporting the instep of the user, the instep support means being raised away from or lowered toward the ankle support means when the lever arm is pivoted away from or toward the leg support beam, respectively;

guide means engaged with the lever arm for guiding pivotal motion of the lever arm toward and away from the leg support beam;

a latch on the guide means;

a spring-biased detent on the lever arm for engaging the latch in a snap lock when the lever arm is lowered toward the leg support beam for holding the instep support means in a leg clamping position spaced from the ankle support means, with the lever arm being held in a positively locked position preventing the lever arm from pivoting away from the leg support beam; and means for moving the lever arm axially relative to the leg support beam against the bias of the spring-biased detent for releasing the detent from its locked position on the latch for allowing the lever arm to rotate away from the locked position to widen the spacing between the instep support means and the ankle suport means.

2. Apparatus according to claim 1 in which the guide means comprises a rigid projection affixed to the leg support beam and extending through an opening in the lever arm.

3. Apparatus according to claim 2 including stop means on the projection to confine pivotal rotation of the lever arm to the length of the projection.

4. Apparatus according to claim 2 in which the lever arm comprises a pair of telescoping tubes, the innermost tube having said spring-biased detent, the innermost tube being movable out of the outermost tube against the bias of the spring; the projection extending through the openings in both tubes.

5. Apparatus according to claim 1 including means for adjusting the angle of inclination of the body-supporting frame.

6. Apparatus according to claim 5 in which the means for adjusting the angle of inclination of the body-supporting frame, comprising telescoping legs on the means for mounting the body-supporting frame, the telescoping legs being slidable lengthwise to increase the angle of inclination; and a locking pin for releasably securing each telescoping leg in a selected position on the frame mounting means.

7. Apparatus according to claim 6 including a separate brace between each side of the body-supporting frame and the frame mounting means, each brace and the frame mounting means being of fixed length, while the telescoping legs are adjustable in length for setting the angle of inclination.

8. Apparatus according to claim 1 including means for adjusting the vertical spacing between the ankle support means and the instep support means.

9. Apparatus according to claim 8 in which the means for adjusting the vertical spacing between the ankle support means and the instep support means, comprising a lateral upper support bar carried on the lever arm, the instep support means being mounted on opposite sides of the upper support bar; and means for raising or lowering the upper support bar relative to the lever arm for adjusting the vertical position of the instep support means relative to the lever arm.

10. Apparatus according to claim 8 including means for adjusting the longitudinal spacing between the ankle support means and the instep support means.

11. Apparatus according to claim 10 in which the means for adjusting the longitudinal spacing between the ankle support means and the instep support means, comprising a lateral lower support bar carried on the leg support beam, the ankle support means being mounted on opposite sides of the lower support bar, a series of holes axially spaced apart along the beam, a pin for engaging any one of the holes to hold the lower support bar on the beam, and means for loosening the lower support bar from the beam to remove the pin from the holes and for tightening the lower support bar on the beam to hold the ankle support means in a fixed axial position on the beam.

12. Apparatus according to claim 11 including means for adjusting the vertical spacing between the ankle support means and the instep support means, comprising a lateral upper support bar carried on the lever arm, the instep support means being mounted on opposite sides of the upper support bar; and means for raising or lowering the upper support bar relative to the lever arm for adjusting the vertical position of the instep support means relative to the lever arm.

13. Apparatus according to claim 1 including means for adjusting the axial position of the leg support beam on the body-supporting frame.

14. Apparatus according to claim 13 in which the means for adjusting the axial position of the leg support beam on the body-supporting frame, comprising a series of holes in the beam; a fixed locking pin carried on the body-supporting frame for engaging any one of the holes; an oversized bracket for holding the beam with the locking pin engaged in one of the holes, the beam being removable from the pin by moving it away from the bracket; and a movable latch that positively locks the beam on the bracket with the locking pin engaged in the hole, the latch being movable away from the beam to allow the beam to move away from its locked position so the beam can move lengthwise for positioning the locking pin with respect to any other of the holes in the beam.

* * * * *